US010982872B2

(12) United States Patent
Roosli

(10) Patent No.: US 10,982,872 B2
(45) **Date of Patent: *Apr. 20, 2021**

(54) MANAGING ENERGY IN A MULTI-DWELLING UNIT

(71) Applicant: Honeywell International Inc., Morris Plains, NJ (US)

(72) Inventor: Philipp Anton Roosli, Nantic, CT (US)

(73) Assignee: Honeywell International Inc., Charlotte, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/894,716

(22) Filed: Jun. 5, 2020

(65) Prior Publication Data

US 2020/0386437 A1 Dec. 10, 2020

Related U.S. Application Data

(63) Continuation of application No. 14/311,503, filed on Jun. 23, 2014, now Pat. No. 10,697,660.

(51) Int. Cl.

| | |
|---|---|
| ***F24F 11/62*** | (2018.01) |
| ***F24F 11/30*** | (2018.01) |
| ***F24F 11/46*** | (2018.01) |

(52) U.S. Cl.

CPC ..... *F24F 11/62* (2018.01); *F24F 11/30* (2018.01); *F24F 11/46* (2018.01)

(58) Field of Classification Search

CPC .... G06Q 10/06375; F24F 11/30; F24F 11/46; F24F 11/62

See application file for complete search history.

(56) References Cited

U.S. PATENT DOCUMENTS 4,060,123 A * 11/1977 Hoffman ..... F24D 19/10 165/11.1
5,165,465 A * 11/1992 Kenet ..... G08B 13/19 165/11.1

(Continued)

FOREIGN PATENT DOCUMENTS

AU 2013224733 10/2013
WO 01/06612 1/2001

(Continued)

OTHER PUBLICATIONS

Bhatia, HVAC Variable Refrigerant Flow Systems, CED engineering.com, Published Online Jun. 26, 2013, https://web.archive.org/ web/20130626031752/http://www.seedengr.comNariable%20Refrigerant%20Flow%20Systems.pdf. (Year: 2013).

(Continued)

*Primary Examiner* — Michael J Dalbo
(74) *Attorney, Agent, or Firm* — Seager, Tufte & Wickhem, LLP

(57) ABSTRACT

Methods, devices, and systems for managing energy in a multi-dwelling unit are described herein. One method includes determining an energy consumption of each of a plurality of heating, ventilation, and air conditioning (HVAC) units, wherein each of the plurality of HVAC units is associated with a different space of a multi-dwelling unit having a plurality of spaces, normalizing the energy consumption of each of the plurality of HVAC units, and ranking the normalized energy consumptions.

19 Claims, 4 Drawing Sheets

(56) References Cited

U.S. PATENT DOCUMENTS

| | | | | |
|---|---|---|---|---|
| 6,536,675 | B1 | 3/2003 | Pesko et al. | |
| 7,809,472 | B1 | 10/2010 | Silva | |
| 8,532,839 | B2 | 9/2013 | Drees et al. | |
| 8,560,128 | B2 | 10/2013 | Ruff et al. | |
| 10,697,660 | B2 * | 6/2020 | Roosli | F24F 11/30 |
| 2002/0178047 | A1 * | 11/2002 | Or | G06Q 10/04 705/412 |
| 2003/0229572 | A1 | 12/2003 | Raines et al. | |
| 2004/0267567 | A1 * | 12/2004 | Barrera | G06Q 30/06 705/2 |
| 2006/0004492 | A1 | 1/2006 | Terlson et al. | |
| 2007/0043478 | A1 | 2/2007 | Ehlers et al. | |
| 2008/0083234 | A1 | 4/2008 | Krebs et al. | |
| 2008/0177678 | A1 | 7/2008 | Di Martini et al. | |
| 2009/0005912 | A1 | 1/2009 | Srivastava et al. | |
| 2010/0042453 | A1 | 2/2010 | Scaramellino et al. | |
| 2010/0076605 | A1 | 3/2010 | Harrod et al. | |
| 2010/0100253 | A1 | 4/2010 | Fausak et al. | |
| 2010/0211222 | A1 | 8/2010 | Ghosn | |
| 2010/0286937 | A1 * | 11/2010 | Hedley | G06Q 50/06 702/60 |
| 2011/0224947 | A1 | 9/2011 | Kriss | |
| 2013/0331999 | A1 | 12/2013 | Vaughn et al. | |
| 2013/0342359 | A1 * | 12/2013 | Miyaji | G01D 4/002 340/870.03 |
| 2014/0107850 | A1 | 4/2014 | Curtis | |
| 2015/0028848 | A1 | 1/2015 | Lynch et al. | |
| 2015/0058740 | A1 | 2/2015 | Asahi | |
| 2016/0077532 | A1 | 3/2016 | Lagerstedt et al. | |

FOREIGN PATENT DOCUMENTS

| | | |
|---|---|---|
| WO | 20100129913 | 11/2010 |
| WO | 2012031279 | 3/2012 |
| WO | 2013/149210 | 10/2013 |
| WO | 2013/163202 | 10/2013 |

OTHER PUBLICATIONS

Donnelly, et al. "LEAN Energy Analysis, Using Regression Analysis to Assess Building Energy Performance", Institute for Building Efficiency. Johnson Controls. Mar. 2013. 12 pgs.

"Energy Star Portfolio Manager Methodology for Accounting for Weather", Found at http://www.energystar.gov/ia/business/evaluate_performance/Methodology_Weather_20110224.pdf. Feb. 24, 2011. 9 pgs.

"How to reduce your energy use", Greater Toronto CivicAction Alliance. Found at http://racetoreduce.ca/taking-action/tools-and-resources/flowchart/#&panel1-1. Retrieved on Dec. 2, 2013.

Hygh, et al. "Multivariate regression as an energy assessment tool in early building design". Building and Environment 57 (2012) 165-175.

* cited by examiner

MANAGING ENERGY IN A MULTI-DWELLING UNIT

The present application is a continuation of U.S. application Ser. No. 14/311,503, filed Jun. 23, 2014 and titled, "MANAGING ENERGY IN A MULTI-DWELLING UNIT", incorporated herein by reference.

TECHNICAL FIELD

The present disclosure relates to devices, methods, and systems for managing energy in a multi-dwelling unit.

BACKGROUND

A multi-dwelling unit (MDU), such as a hotel, for instance, can include a heating, ventilation, and air conditioning (HVAC) system for maintaining the environment (e.g., temperature, humidity, etc.) of the unit at a comfortable level for the occupant(s) (e.g., guest(s)) of the unit. The HVAC system can include a plurality of HVAC units (e.g., each associated with a different unit of the MDU). Each HVAC unit can include, for example, HVAC equipment (e.g., fan, hot and/or cold water valve, exhaust grill, air conditioner, fan coil, etc.) and a controller (e.g., thermostat) that controls the operation of the HVAC unit.

In various instances, HVAC units throughout an MDU may be analogous (e.g., of same or similar make, model, capability, power usage, etc.). However, the spaces of the MDU associated with the HVAC units may vary in several respects. As one example, a first space may receive more sunlight than a second space, thus reducing the first space's energy consumption (e.g., via heating) with respect to the second space.

Previous approaches to managing energy in an MDU may apply similar maintenance and/or budgetary attention to each HVAC unit (e.g., using a time-scheduled maintenance approach). However, applying the same amount of such resources to each HVAC unit can result in reduced efficiencies given that energy consumption, and therefore maintenance needs, may vary across the HVAC units.

DETAILED DESCRIPTION

Figure 1:
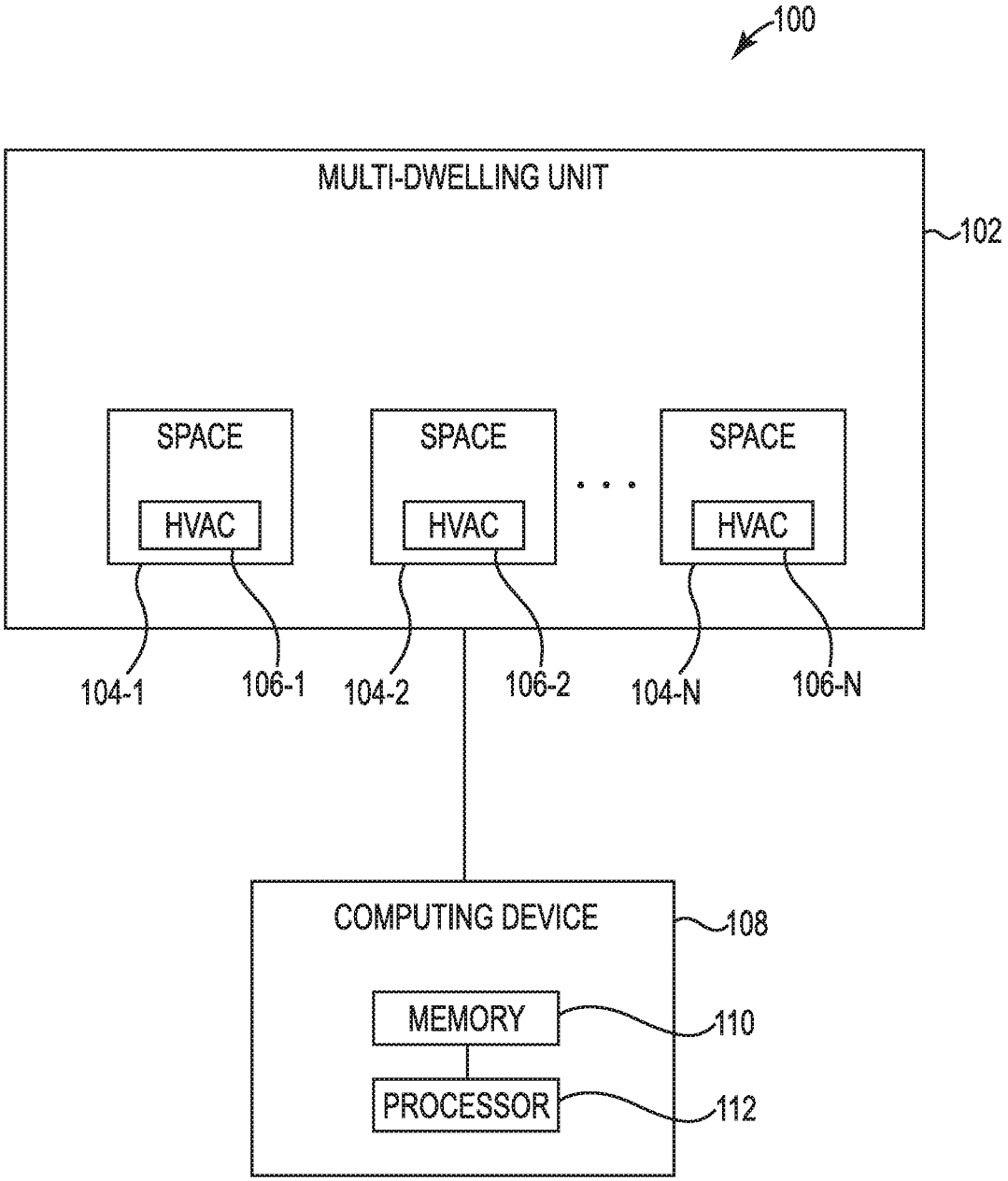
FIG. 1 illustrates a system for managing energy in a multi-dwelling unit in accordance with one or more embodiments of the present disclosure.

Methods, devices, and systems for managing energy in a multi-dwelling unit are described herein. For example, one or more embodiments include determining an energy consumption of each of a plurality of heating, ventilation, and air conditioning (HVAC) units, wherein each of the plurality of HVAC units is associated with a different space of a multi-dwelling unit having a plurality of spaces, normalizing the energy consumption of each of the plurality of HVAC units, and ranking the normalized energy consumptions.

Energy management in accordance with one or more embodiments of the present disclosure can conserve energy over previous approaches, thus yielding cost savings for those operating a multi-dwelling unit. For example, HVAC units of a multi-dwelling unit can be monitored and/or metered to determine energy consumption. Once determined, energy consumptions across HVAC units can normalized and compared. Labor and monetary resources can be directed towards HVAC units that are deserving (e.g., having higher normalized energy consumptions), rather than blanketed across all HVAC units evenly (as in previous approaches).

For example, in a hotel, energy consumption for two spaces (e.g., rooms) can be determined and compared over a time period (e.g., a year). If one of the spaces consumes significantly more energy than the other, embodiments of the present disclosure can determine a cause for the increased energy consumption. If a cause can be determined and/or remedied, energy conservation associated with that space can be realized. Conversely, applying the same amount of maintenance and/or budgetary resources to the second space (which already runs more energy efficient) may not likely yield the same energy savings. Thus, embodiments of the present disclosure can allow for strategic application of resources, yielding cost savings over previous (e.g., time-scheduled) approaches.

In the following detailed description, reference is made to the accompanying drawings that form a part hereof. The drawings show by way of illustration how one or more embodiments of the disclosure may be practiced.

These embodiments are described in sufficient detail to enable those of ordinary skill in the art to practice one or more embodiments of this disclosure. It is to be understood that other embodiments may be utilized and that process changes may be made without departing from the scope of the present disclosure.

As will be appreciated, elements shown in the various embodiments herein can be added, exchanged, combined, and/or eliminated so as to provide a number of additional embodiments of the present disclosure. The proportion and the relative scale of the elements provided in the figures are intended to illustrate the embodiments of the present disclosure, and should not be taken in a limiting sense.

The figures herein follow a numbering convention in which the first digit or digits correspond to the drawing figure number and the remaining digits identify an element or component in the drawing. Similar elements or components between different figures may be identified by the use of similar digits. As used herein, the designator "N," particularly with respect to reference numerals in the drawings, indicates that a number of the particular feature so designated can be included.

FIG. 1 illustrates a system 100 for managing energy in a multi-dwelling unit in accordance with one or more embodiments of the present disclosure. As shown in FIG. 1, system 100 includes a multi-dwelling unit (MDU) 102 and a computing device 108. Computing device 108 can be a part of a building control system associated with the MDU 102, for instance. The MDU 102 can be one or more structures containing a plurality of distinct spaces (e.g., a space 104-1, a space 104-2, . . . a space 104-N). For example, the MDU 102 can be a hotel, a motel, an apartment and/or condominium complex, etc. The space 104-1, the space 104-2, and the space 104-N are sometimes referred to collectively herein as "spaces 104."

Spaces 104 can be units for permanent and/or temporary housing (e.g., rooms, suites, living areas, etc.). Spaces 104 are not limited to housing, however, and can be any distinct units of a multi-dwelling unit. For example, spaces 104 can be units associated with equipment, plants, animals, etc.

Each of the spaces 104 can include a respective HVAC unit. As shown in FIG. 1, the space 104-1 includes an HVAC unit 106-1, the space 104-2 includes an HVAC unit 106-2, and the space 104-N includes an HVAC unit 106-N. The HVAC unit 106-1, the HVAC unit 106-2, and the HVAC unit 106-N are sometimes referred to collectively herein as "HVAC units 106."

Each of the HVAC units 106 can include HVAC equipment (e.g., fan, hot and/or cold water valve, exhaust grill, air conditioner, fan coil, etc.) and a controller (e.g., thermostat) that controls the operation of the HVAC equipment. For example, the temperature of unit 104-1 can be controlled using HVAC unit 106-1.

Each of the HVAC units 106 can be communicatively coupled (e.g., wired and/or wirelessly coupled) to the computing device 108 such that data (e.g., operational data) can be sent in any direction between the HVAC units 106 and the computing device 108. The computing device 108 can be, for example, a laptop computer, a desktop computer, or a mobile device (e.g., a mobile phone, a personal digital assistant, a smart phone, a tablet, etc.), among other types of computing devices.

As shown in FIG. 1, computing device 108 includes a memory 110 and a processor 112 coupled to the memory 110. The memory 110 can be any type of storage medium that can be accessed by processor 112 to perform various examples of the present disclosure. For example, the memory 110 can be a non-transitory computer readable medium having computer readable instructions (e.g., computer program instructions) stored thereon that are executable by processor 112 to manage energy in an MDU (e.g., MDU 102) in accordance with one or more embodiments of the present disclosure.

The memory 110 can be volatile or nonvolatile memory. The memory 110 can also be removable (e.g., portable) memory, or non-removable (e.g., internal) memory. For example, the memory 110 can be random access memory (RAM) (e.g., dynamic random access memory (DRAM) and/or phase change random access memory (PCRAM)), read-only memory (ROM) (e.g., electrically erasable programmable read-only memory (EEPROM) and/or compact-disc read-only memory (CD-ROM)), flash memory, a laser disc, a digital versatile disc (DVD) or other optical disk storage, and/or a magnetic medium such as magnetic cassettes, tapes, or disks, among other types of memory.

Further, although the memory 110 is illustrated as being located in computing device 108, embodiments of the present disclosure are not so limited. For example, memory 110 can also be located internal to another computing resource (e.g., enabling computer readable instructions to be downloaded over the Internet or another wired or wireless connection). Additionally, though the computing device 108 is illustrated as being external to MDU 102, the computing device 108 can be located in MDU 102. In some embodiments, the computing device 108 can be a part of a building control system associated with the MDU 102.

Figure 2:
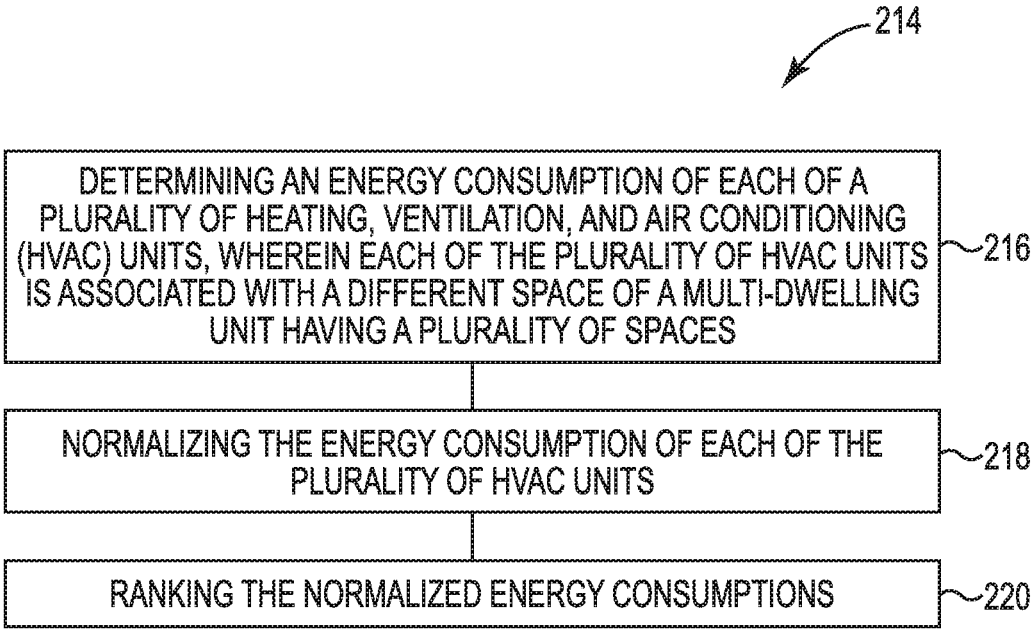
FIG. 2 illustrates a method for managing energy in a multi-dwelling unit in accordance with one or more embodiments of the present disclosure.

FIG. 2 illustrates a method 214 for managing energy in a multi-dwelling unit (e.g., MDU 102 previously described in connection with FIG. 1). in accordance with one or more embodiments of the present disclosure. Method 214 can be performed, for example, by a computing device, such as computing device 108, previously described in connection with FIG. 1.

At block 216, method 214 includes determining an energy consumption of each of a plurality of heating, ventilation, and air conditioning (HVAC) units, wherein each of the plurality of HVAC units is associated with a different space of a multi-dwelling unit having a plurality of spaces. The plurality of HVAC units and spaces can be, for example, HVAC units 106 and spaces 104, respectively, previously described in connection with FIG. 1.

Determining the energy consumption can include receiving operational data from each of the plurality of HVAC units. For example, operational data can include a run time associated with a heat setting and a run time associated with a cool setting of each of the plurality of HVAC units. That is, the energy consumption can include the energy consumption during a cooling, heating and/or fan run time. Operational data can be associated with, and/or received over, a particular period of time (e.g., a month, a year, etc.). That is, the energy consumption can be determined during the period of time. Operational data can be gathered continuously and/or tracked.

At block 218, method 214 includes normalizing the energy consumption of each of the plurality of HVAC units. Normalizing the energy consumptions can include determining the amount of energy that a particular HVAC unit would have consumed over a particular time period if, for example, the HVAC unit (and/or the space associated with the HVAC unit) associated with the MDU would have experienced average parameters (e.g., conditions) over that time period.

The energy consumption of each of the plurality of HVAC units can be normalized based on the respective operational data from each of the plurality of HVAC units. For example, the energy consumption during the cooling run time, the heating run time, and the fan run time can be normalized. Further, although not shown in FIG. 2, method 214 can include receiving a plurality of parameters associated with each of the plurality of spaces. The energy consumption of each of the plurality of HVAC units can be normalized based on the respective plurality of parameters associated with each of the plurality of spaces The plurality of parameters can be conditions and/or configurations affecting an operation of an HVAC unit. For example, the plurality of parameters can include occupancy data associated with each of the plurality of spaces, such as the amount of time each respective space is occupied or vacated. The amount of time that a particular space is occupied or vacated may affect the operation of its HVAC unit, for instance. In some embodiments, occupancy data can be received from key (e.g., card) readers associated with spaces (e.g., real-time occupancy data). Occupancy data can, for example, further include a rental history associated with each of the plurality of spaces.

The plurality of parameters can include a volume and/or size of each of the plurality of spaces. The volume and/or size of a particular space may affect the power consumed by its HVAC unit (e.g., an HVAC unit in a larger space may likely consume more power than a smaller one). Further, the plurality of parameters can include a distance of a space of the plurality of spaces from an HVAC feeder pipe associated with the multi-dwelling unit. For example, HVAC units in spaces closer to a feeder pipe may heat and/or cool more efficiently than those farther away.

The plurality of parameters can include a sun exposure (e.g., amount and/or intensity of sun exposure) associated with each of the plurality of spaces. The plurality of spaces can include a space type of each of the plurality of spaces (e.g., an HVAC unit in a suite may consume a different amount of power than an HVAC unit in a single room).

The plurality of parameters can include an HVAC unit type associated with each of the plurality of spaces. Though HVAC units may be similar across a plurality of spaces, differences between the unit type (e.g., make, model, year, maintenance history, etc.) may be used to normalize energy consumption.

Normalizing the energy consumptions can include performing a multi-variate regression analysis and/or a determination of a normalized energy intensity index associated with each space. In some embodiments, HVAC units having increased energy consumptions may be more likely to have dirty air filters, clogged water pipes associated with fan coils or heat pumps, valve, valve motor and/or compressor problems, issues associated with make-up air supply and/or space insulation, etc.

While energy consumptions can be normalized, embodiments of the present disclosure can additionally normalize subsets of energy consumption. That is, respective energy consumptions for heating, cooling, and/or fan operation can be normalized, for instance, among others.

At block 220, method 214 includes ranking the normalized energy consumptions. Once normalized, energy consumptions can be ranked (e.g., the plurality of HVAC units can be ranked according to the normalized energy consumption associated with each of the plurality of HVAC units). The ranking of the plurality of HVAC units can allow embodiments of the present disclosure to prioritize a maintenance budget associated with an MDU, for instance.

In some embodiments, HVAC units having a higher rank may receive a greater proportion of maintenance and/or a maintenance budget than those having a decreased rank. In some embodiments, maintenance and/or a maintenance budget may be scheduled for and/or designated to a subset of HVAC units whose normalized energy consumption exceeds a particular threshold (e.g., a particular rank, level, and/or amount).

Further, in some embodiments, normalized energy consumptions across an MDU may be compared to those of another MDU. That is, the normalized energy consumptions associated with each of the plurality of HVAC units can be compared to normalized energy consumptions associated with each of an additional plurality of HVAC units of an additional MDU. For example, a company operating more than one MDU may desire to prioritize maintenance and/or a maintenance budget not only on a space-to-space basis, but between MDUs as well.

Figure 3:
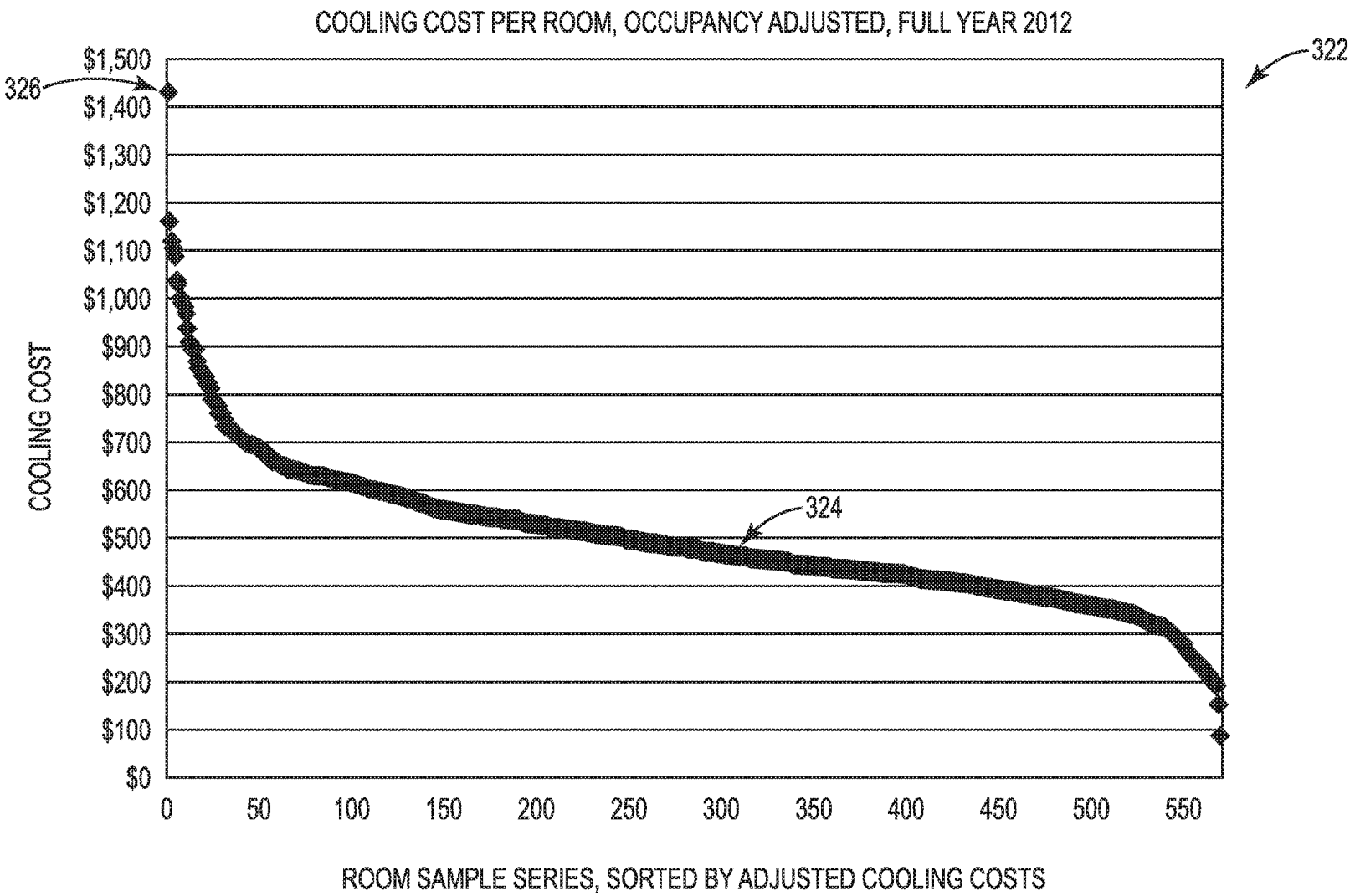
FIG. 3 illustrates an example graph depicting normalized energy consumptions for a plurality of units of a multi-dwelling unit in accordance with one or more embodiments of the present disclosure.

FIG. 3 illustrates an example graph 322 depicting normalized energy consumptions for a plurality of HVAC units associated with spaces of a multi-dwelling unit in accordance with one or more embodiments of the present disclosure. In the example illustrated in FIG. 3, the time period is one year (e.g., 2012). Graph 322 includes an x-axis representing the HVAC units of the MDU (illustrated in FIG. 3 as "room sample series, sorted by adjusted cooling costs"). For instance, in the example illustrated in FIG. 3, the MDU contains 569 HVAC units. Graph 322 includes a y-axis representing normalized energy consumption (illustrated in FIG. 3 as "cooling cost").

Each HVAC unit of the MDU is represented by a single point in graph 322. For example, the graph 322 includes an HVAC unit 326. When graphed and sorted by normalized energy consumption, the points representing HVAC units form a curve 324. The slope and/or shape of the curve 324 may depend on the type of the MDU, the prevailing weather conditions, the number of HVAC units, etc. In some embodiments, the slope and/or shape of the curve 324 can depend on one or more of the plurality of parameters, previously discussed, for instance.

Figure 4:
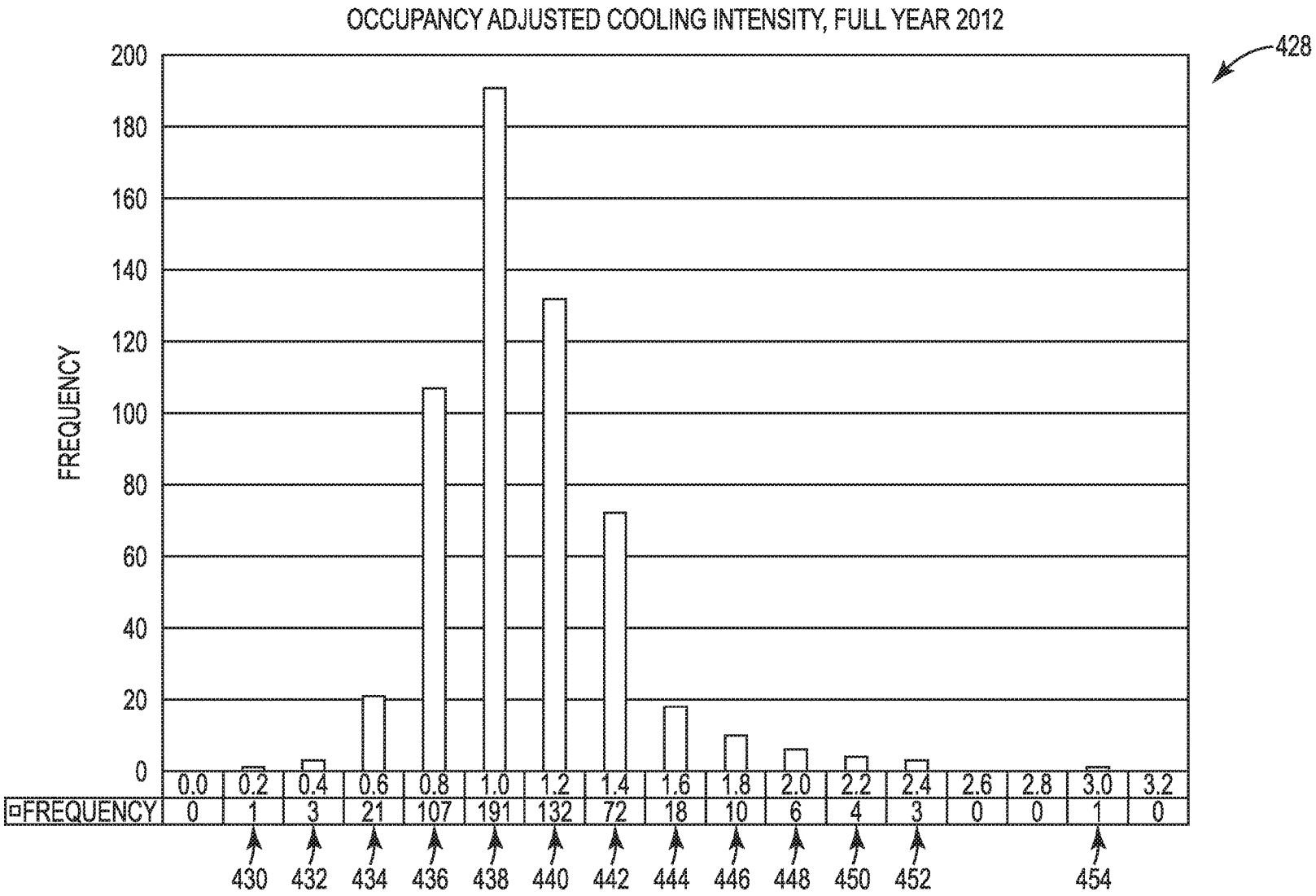
FIG. 4 illustrates an example histogram depicting relative energy consumptions for a plurality of units with respect to an average energy consumption of a multi-dwelling unit in accordance with one or more embodiments of the present disclosure.

FIG. 4 illustrates an example histogram 428 depicting relative energy consumptions for a plurality of HVAC units with respect to an average energy consumption of a multi-dwelling unit in accordance with one or more embodiments of the present disclosure. The example illustrated in FIG. 4 may represent the same MDU as that of FIG. 3, for instance. Histogram 428 includes an x-axis representing relative energy consumption with respect to average energy consumption and a y-axis representing frequency (e.g., number of HVAC units).

As shown in FIG. 4, most of the example HVAC units fall near the average energy consumption (e.g., relative energy consumption 438). As shown in the example histogram 428, one HVAC unit has a relative energy consumption of 0.2 (e.g., relative energy consumption 430), three HVAC units have a relative energy consumption of 0.4 (e.g., relative energy consumption 432), 21 HVAC units have a relative energy consumption of 0.6 (e.g., relative energy consumption 434), 107 HVAC units have a relative energy consumption of 0.8 (e.g., relative energy consumption 436), 191 HVAC units have a relative energy consumption of 1.0 (e.g., relative energy consumption 438), 132 HVAC units have a relative energy consumption of 1.2 (e.g., relative energy consumption 440), 72 HVAC units have a relative energy consumption of 1.4 (e.g., relative energy consumption 442), 18 HVAC units have a relative energy consumption of 1.6 (e.g., relative energy consumption 444), 10 HVAC units have a relative energy consumption of 1.8 (e.g., relative energy consumption 446), 6 HVAC units have a relative energy consumption of 2.0 (e.g., relative energy consumption 448), 4 HVAC units have a relative energy consumption of 2.2 (e.g., relative energy consumption 450), 3 HVAC units have a relative energy consumption of 2.4 (e.g., relative energy consumption 452), and 1 HVAC unit has a relative energy consumption of 3.0 (e.g., relative energy consumption 454).

The graph 322 and the histogram 428 illustrated in FIGS. 3 and 4 respectively, can allow embodiments of the present disclosure to determine HVAC units whose normalized energy consumption exceed a particular threshold, for instance. The HVAC unit 326 illustrated in FIG. 3 can be seen as an outlier. Similarly, the same HVAC unit, illustrated in FIG. 4 as relative energy consumption 454, can be seen as an outlier.

As previously discussed, embodiments of the present disclosure can designate maintenance and/or a maintenance budget to HVAC units whose normalized energy consumption exceeds a particular threshold (e.g., a particular rank, level, and/or amount).

Although specific embodiments have been illustrated and described herein, those of ordinary skill in the art will appreciate that any arrangement calculated to achieve the same techniques can be substituted for the specific embodiments shown. This disclosure is intended to cover any and all adaptations or variations of various embodiments of the disclosure.

It is to be understood that the above description has been made in an illustrative fashion, and not a restrictive one. Combination of the above embodiments, and other embodiments not specifically described herein will be apparent to those of skill in the art upon reviewing the above description.

The scope of the various embodiments of the disclosure includes any other applications in which the above structures and methods are used. Therefore, the scope of various embodiments of the disclosure should be determined with reference to the appended claims, along with the full range of equivalents to which such claims are entitled.

In the foregoing Detailed Description, various features are grouped together in example embodiments illustrated in the figures for the purpose of streamlining the disclosure. This method of disclosure is not to be interpreted as reflecting an intention that the embodiments of the disclosure require more features than are expressly recited in each claim.

Rather, as the following claims reflect, inventive subject matter lies in less than all features of a single disclosed embodiment. Thus, the following claims are hereby incorporated into the Detailed Description, with each claim standing on its own as a separate embodiment.

What is claimed is:

1. A system for determining relative maintenance needs for a plurality of Heating, Ventilation and Air Conditioning (HVAC) systems each servicing a corresponding one of a plurality of units of a multi-unit building, comprising:

a plurality of HVAC systems, each HVAC system of the plurality of HVAC systems associated with a different unit of a multi-unit building;

a computing device operatively coupled to each of the plurality of HVAC systems, the computing device configured to:

receive operational data from each of the plurality of HVAC systems;

receive a plurality of parameters associated with each of the units of the multi-unit building;

normalize an energy consumption of each of the plurality of HVAC systems based on the respective operational data from each of the plurality of HVAC systems and one or more of the respective plurality of parameters associated with each of the plurality of units, where the energy consumption of each of the plurality of HVAC systems includes energy consumption attributed to cooling the corresponding unit, energy consumption attributed to heating the corresponding unit, and energy consumption attributed to fan operation in the corresponding unit without heating or cooling, and wherein normalizing the energy consumption of each of the plurality of HVAC systems includes normalizing subsets of energy consumptions corresponding to two or more of energy consumption attributed to cooling, energy consumption attributed to heating, and energy consumption attributed to fan operation in the unit without heating or cooling; and identifying for maintenance one or more of the plurality of HVAC systems that have a normalized energy consumption exceeding a particular threshold.

2. The system of claim 1, wherein the plurality of parameters associated with each of the units of the multi-unit building include one or more of unit occupancy data, unit size, unit sun exposure data, and type of HVAC system servicing the unit, and wherein normalize the energy consumption of each of the plurality of HVAC systems is further based on one or more of the unit occupancy data, the unit size, the unit sun exposure, and the type of HVAC system servicing the unit.

3. The system of claim 1, wherein the plurality of parameters associated with each of the units of the multi-unit building include a distance from an HVAC feeder pipe associated with the multi-unit building, wherein normalize the energy consumption of each of the plurality of HVAC systems is further based on the distance from the HVAC feeder pipe.

4. The system of claim 1, wherein normalizing the energy consumption of each of the plurality of HVAC systems includes normalizing subsets of energy consumptions that correspond to energy consumption attributed to cooling and energy consumption attributed to heating.

5. The system of claim 1, wherein normalizing the energy consumption of each of the plurality of HVAC systems includes normalizing subsets of energy consumptions that correspond to energy consumption attributed to cooling and energy consumption attributed to fan operation without heating or cooling.

6. The system of claim 1, wherein normalizing the energy consumption of each of the plurality of HVAC systems includes normalizing subsets of energy consumptions that correspond to energy consumption attributed to heating and energy consumption attributed to fan operation without heating or cooling.

7. The system of claim 1, wherein the operational data comprises one or more of a run time attributed to cooling, a run time attributed to heating and a run time attributed to fan operation without heating or cooling.

8. The system of claim 1, wherein the operational data comprises one or more of a run time associated with a heat setting and a run time associated with a cool setting.

9. The system of claim 1, wherein the computing device is part of a building control system associated with the multi-unit building.

10. A system for determining relative maintenance needs for a plurality of Heating, Ventilation and Air Conditioning (HVAC) systems each servicing a corresponding one of a plurality of units of a multi-unit building, comprising:

a plurality of HVAC systems, each HVAC system of the plurality of HVAC systems associated with a different unit of a multi-unit building; and a computing device operatively coupled to each of the plurality of HVAC systems, the computing device configured to:

receive operational data from each of the plurality of HVAC systems;

receive a plurality of parameters associated with each of the units of the multi-unit building, the plurality of parameters including unit occupancy data and unit sun exposure data;

normalize an energy consumption of each of the plurality of HVAC systems based on the respective operational data from each of the plurality of HVAC systems and at least some of the respective plurality of parameters associated with each of the plurality of units including the unit occupancy data and the unit sun exposure data, where the energy consumption of each of the plurality of HVAC systems includes energy consumption attributed to cooling the corresponding unit, energy consumption attributed to heating the corresponding unit, and energy consumption attributed to fan operation in the corresponding unit without heating or cooling, and wherein normalizing the energy consumption of each of the plurality of HVAC systems includes normalizing subsets of energy consumptions corresponding to each of two or more of energy consumption attributed to cooling, energy consumption attributed to heating, and energy consumption attributed to fan operation in the unit without heating or cooling; and identifying for maintenance one or more of the plurality of HVAC systems that have a normalized energy consumption exceeding a particular threshold.

11. The system of claim 10, wherein the plurality of parameters associated with each of the units of the multi-unit building further include a type of HVAC system servicing the unit, and wherein normalize the energy consumption of each of the plurality of HVAC systems is further based on the type of HVAC system.

12. The system of claim 10, wherein the multi-unit building includes a hotel with each unit corresponding to a guest room of the hotel, and wherein the unit occupancy data is based at least in part on a rental history of the corresponding guest room.

13. The system of claim 10, wherein the multi-unit building includes a hotel with each unit corresponding to a guest room of the hotel, and wherein the unit occupancy data is based at least in part on a key reader associated with the corresponding guest room.

14. The system of claim 10, wherein the unit occupancy data is based at least in part on real time occupancy data.

15. A system for determining relative maintenance needs for a plurality of Heating, Ventilation and Air Conditioning (HVAC) systems each servicing a corresponding one of a plurality of units of a multi-unit building, comprising:

a plurality of HVAC systems, each HVAC system of the plurality of HVAC systems associated with a different unit of a multi-unit building; and a computing device operatively coupled to each of the plurality of HVAC systems, the computing device configured to:

receive operational data from each of the plurality of HVAC systems;

receive a plurality of parameters associated with each of the units of the multi-unit building, the plurality of parameters including unit occupancy data and a type of HVAC system servicing the unit;

normalize an energy consumption of each of the plurality of HVAC systems based on the respective operational data from each of the plurality of HVAC systems and at least some of the respective plurality of parameters associated with each of the plurality of units including unit occupancy data and the type of HVAC system, where the energy consumption of each of the plurality of HVAC systems includes energy consumption attributed to cooling the corresponding unit, energy consumption attributed to heating the corresponding unit, and/or energy consumption attributed to fan operation in the corresponding unit without heating or cooling, and wherein normalizing the energy consumption of each of the plurality of HVAC systems includes normalizing subsets of energy consumptions corresponding to each of two or more of energy consumption attributed to cooling, energy consumption attributed to heating, and energy consumption attributed to fan operation in the unit without heating or cooling; and identifying for maintenance one or more of the plurality of HVAC systems that have a normalized energy consumption exceeding a particular threshold.

16. The system of claim 15, wherein the plurality of parameters associated with each of the units of the multi-unit building include a distance from an HVAC feeder pipe associated with the multi-unit building, and wherein normalize the energy consumption of each of the plurality of HVAC systems is further based on the distance from the HVAC feeder pipe.

17. The system of claim 15, wherein the multi-unit building includes a hotel with each unit corresponding to a guest room of the hotel, and wherein the unit occupancy data is based at least in part on a rental history of the corresponding guest room.

18. The system of claim 15, wherein the multi-unit building includes a hotel with each unit corresponding to a guest room of the hotel, and wherein the unit occupancy data is based at least in part on a key reader associated with the corresponding guest room.

19. The system of claim 15, wherein the unit occupancy data is based at least in part on real time occupancy data.

* * * * *